US009732460B2

(12) United States Patent
Benne et al.

(10) Patent No.: US 9,732,460 B2
(45) Date of Patent: Aug. 15, 2017

(54) FABRIC TREATMENT APPLIANCE CONTROL PANEL AND ASSOCIATED STEAM OPERATIONS

(71) Applicant: Whirlpool Corporation, Benton Harbor, MI (US)

(72) Inventors: Thomas Benne, Schorndorf (DE); Matthew T. Doll, Stevensville, MI (US); Carolyn Y. Groppel, Stevensville, MI (US); Claudia Schuler, Schorndorf (DE); Casey J. Tubman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 842 days.

(21) Appl. No.: 13/751,383

(22) Filed: Jan. 28, 2013

(65) Prior Publication Data

US 2013/0117945 A1 May 16, 2013

Related U.S. Application Data

(62) Division of application No. 11/745,257, filed on May 7, 2007, now Pat. No. 8,393,183.

(51) Int. Cl.

| | |
|---|---|
| ***D06F 39/00*** | (2006.01) |
| ***D06F 39/14*** | (2006.01) |
| ***D06F 58/28*** | (2006.01) |

(52) U.S. Cl.
CPC ..... *D06F 39/008* (2013.01); *D06F 39/005* (2013.01); *D06F 39/14* (2013.01); *D06F 58/28* (2013.01)

(58) Field of Classification Search
CPC ..... D06F 39/008; D06F 2202/00; D06F 2202/02; D06F 2202/04; D06F 2202/12; A61L 2/07; A61L 2/24; A61L 2/26
See application file for complete search history.

(56) References Cited

U.S. PATENT DOCUMENTS

| | | | | |
|---|---|---|---|---|
| 2,613,130 | A * | 10/1952 | Jewell | A61L 2/24 202/189 |
| 4,060,057 | A | 11/1977 | Carteus et al. | |
| 4,353,990 | A | 10/1982 | Manske et al. | |
| 6,363,755 | B1 * | 4/2002 | Hapke | D06F 37/42 210/146 |
| 2006/0101586 | A1 * | 5/2006 | Park | D06F 39/008 8/149 |

FOREIGN PATENT DOCUMENTS

| | | | |
|---|---|---|---|
| KR | WO 2005115095 A2 * | 12/2005 | D06F 35/00 |
| KR | WO 2006098571 A1 * | 9/2006 | D06F 33/02 |

* cited by examiner

*Primary Examiner* — David Cormier

(57) ABSTRACT

A fabric treatment appliance capable of indicating when a fabric load is sanitized, implementing a sanitizing by modifying a predetermined operation cycle, or implementing a sanitizing cycle after the completion of a predetermined operation cycle.

13 Claims, 11 Drawing Sheets

FABRIC TREATMENT APPLIANCE CONTROL PANEL AND ASSOCIATED STEAM OPERATIONS

CROSS-REFERENCE TO RELATED APPLICATIONS

The present application represents a divisional application of U.S. patent application Ser. No. 11/745,257 entitled "Fabric Treatment Appliance Control Panel and Associated Steam Operations" filed May 7, 2007, now U.S. Pat. No. 8,393,183, issued Mar. 12, 2013.

BACKGROUND OF THE INVENTION

Field of the Invention

The invention relates to a fabric treatment appliance with a control panel and steam operations associated with the control panel.

Description of the Related Art

Some fabric treatment appliances, such as a washing machine, a clothes dryer, and a fabric refreshing or revitalizing machine, utilize steam generators for various reasons. The steam from the steam generator can be used to, for example, heat water, heat a load of fabric items and any water absorbed by the fabric items, dewrinkle fabric items, remove odors from fabric items, sanitize the fabric items, and sanitize components of the fabric treatment appliance.

SUMMARY OF THE INVENTION

A fabric treatment appliance capable of indicating when a fabric load is sanitized, implementing a sanitizing by modifying a predetermined wash cycle, or implementing a sanitizing cycle after the completion of a predetermined wash cycle.

DESCRIPTION OF EMBODIMENTS OF THE INVENTION

Figure 1:
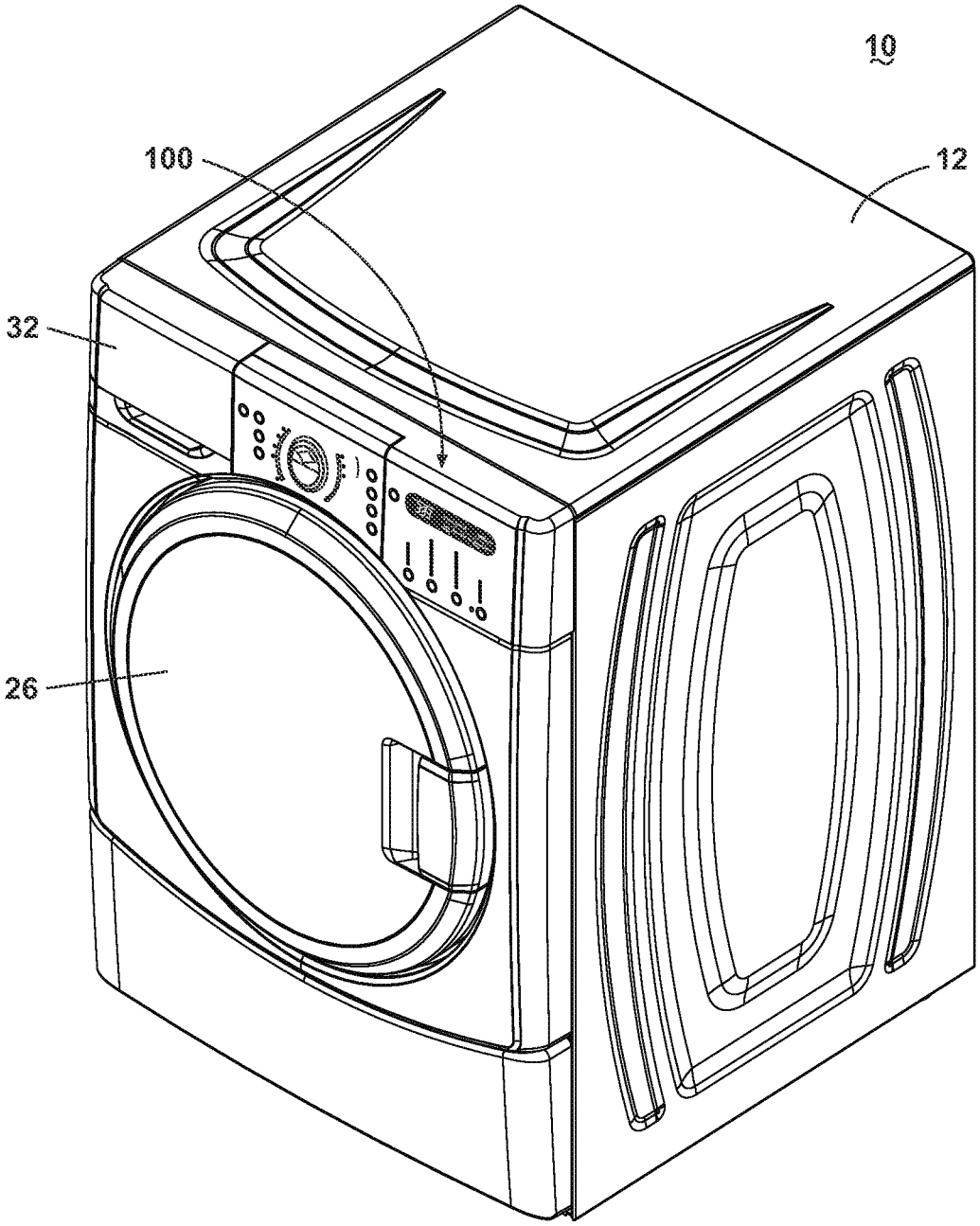
FIG. 1 is a perspective view of an exemplary fabric treatment appliance in the form of a washing machine with an exemplary control panel according to one embodiment of the invention.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine, with it being understood that the invention may be adapted for use with any type of fabric treatment appliance having a steam generator.

Figure 2:
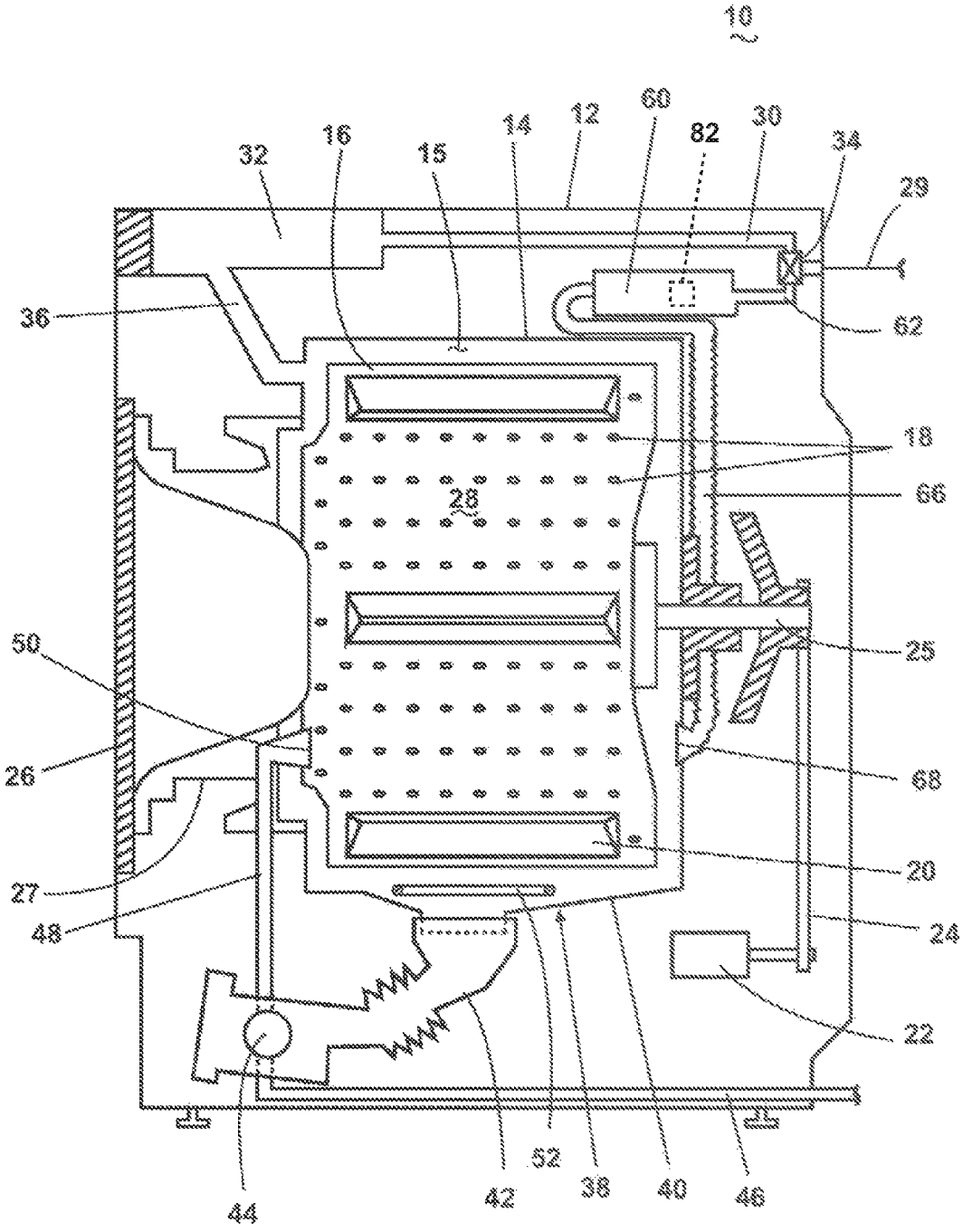
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates, as is well known in the washing machine art. A motor 22 coupled to the drum 16 through a belt 24 and a drive shaft 25 may rotate the drum 16. Both the tub 14 and the drum 16 may be selectively closed by a door 26. A bellows 27 couples an open face of the tub 14 with the cabinet 12, and the door 26 seals against the bellows 27 when the door 26 closes the tub 14. The tub 14, the door 26, and the bellows 27 form a structure that defines a cleaning chamber 28 for receiving fabric items to be cleaned.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. In vertical axis machines, a clothes mover, such as an agitator, auger, impeller, to name a few, moves within a drum to impart mechanical energy directly to the clothes or indirectly through wash liquid in the drum. The clothes mover is typically moved in a reciprocating rotational movement.

The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a household water supply 29. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62. The inlet valve 34 may control flow of the liquid from the water supply 29 and through the second supply conduit 62 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

The steam generator 60 further includes a temperature sensor 82 that can sense a temperature of the steam generator 60 or a temperature representative of the temperature of the steam generator 60. It is within the scope of the disclosure to employ temperature sensors 82 in other locations. For example, the temperature sensor 82 can be a probe-type sensor that extends through the inside surface into the steam generator 60. The temperature sensor 82 can be coupled to a controller 70, which can control the operation of steam generator 60 in response to information received from the temperature sensor 82. The controller 70 can also be coupled to a flow controller, such as to a valve of the flow controller, to control the operation of the flow controller.

An optional sump heater 52 may be located in the sump 38. The sump heater 52 is illustrated as a resistive heating element. The sump heater can be used alone or in combination with the steam generator to add heat to the chamber 15. Typically the sump heater 52, heats water in the sump, which indirectly heats the chamber 15.

The washing machine 10 can further include an exhaust conduit that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, now U.S. Pat. No. 7,841,219, issued Nov. 30, 2010, titled "Fabric Treating Appliance Utilizing Steam," U.S. patent application Ser. No. 11/464,501, now U.S. Pat. No. 7,665,332, issued Feb. 23, 2010, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may have a heating element located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, now U.S. Pat. No. 7,707,859, issued May 4, 2010 titled "Water Supply Control for a Steam Generator of a Fabric Treatment Appliance," U.S. patent application Ser. No. 11/464,514, now U.S. Pat. No. 7,591,859, issued Sep. 22, 2009, titled "Water Supply Control for a Steam Generator of a Fabric Treatment Appliance Using a Weight Sensor," and U.S. patent application Ser. No. 11/464,513, now U.S. Pat. No. 7,681,418, issued Mar. 23, 2010, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces hot water. The hot water may be delivered to the tub 14 and/or drum 16 from the steam generator 60. The hot water may be used alone or may optionally mix with cold water in the tub 14 and/or drum 16. Using the steam generator to produce hot water may be useful when the steam generator 60 couples only with a cold water source of the water supply 29. Optionally, the steam generator 60 may be employed to simultaneously supply steam and hot or warm water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, now U.S. Pat. No. 7,627,920, issued Dec. 8, 2009, titled "Method of Operating a Washing Machine Using Steam;" U.S. patent application Ser. No. 11/450,529, now U.S. Pat. No. 7,765,628, issued Aug. 3, 2010, titled "Steam Washing Machine Operation Method Having Dual Speed Spin Pre-Wash;" and U.S. patent application Ser. No. 11/450,620, now U.S. Pat. No. 7,941,885, issued May 17, 2011, titled "Steam Washing Machine Operation Method Having Dry Spin Pre-Wash," all filed Jun. 9, 2006, which are incorporated herein by reference in their entirety.

Figure 3:
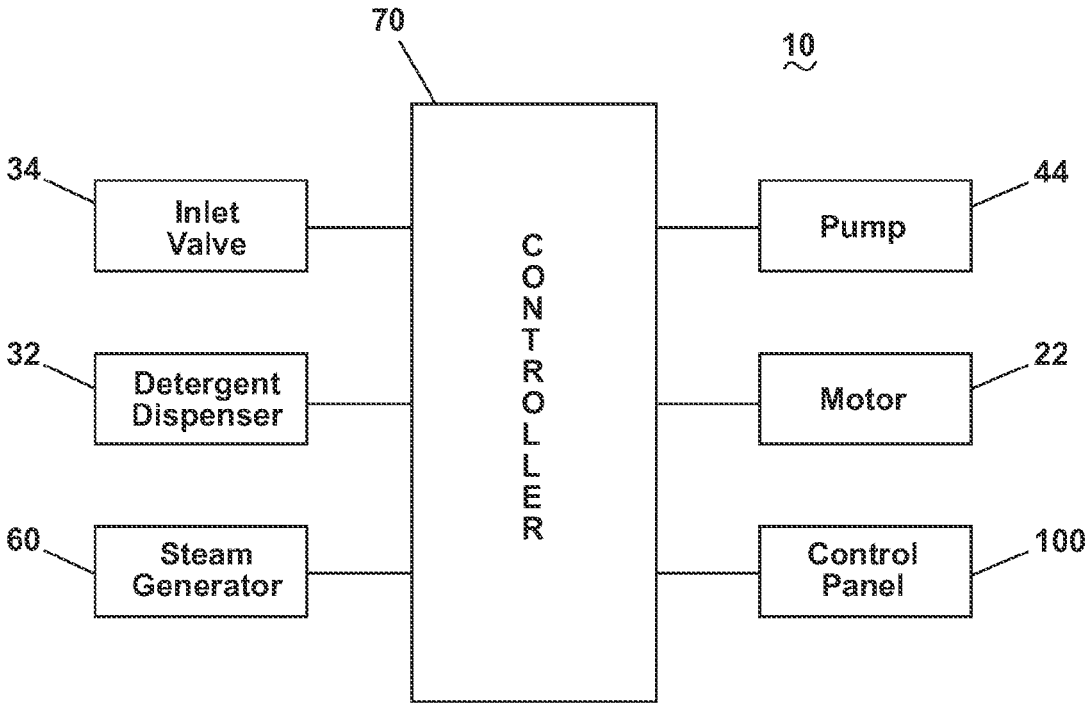
FIG. 3 is a schematic view of an exemplary control system of the fabric treatment appliance of FIG. 1

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller may receive data from the working components and may provide commands, which can be based on the received data, to the working components to execute a desired operation of the washing machine 10. The commands may be data and/or they may be an electrical signal without data. A control panel 100 may be coupled to the controller 70 and may provide for input/output to/from the controller 70. In other words, the control panel 100 performs a user interface function through which a user may enter input related to the operation of the washing machine 10, such as selection and/or modification of an operation cycle of the washing machine 10, and receive output related to the operation of the washing machine 10.

Figure 4:
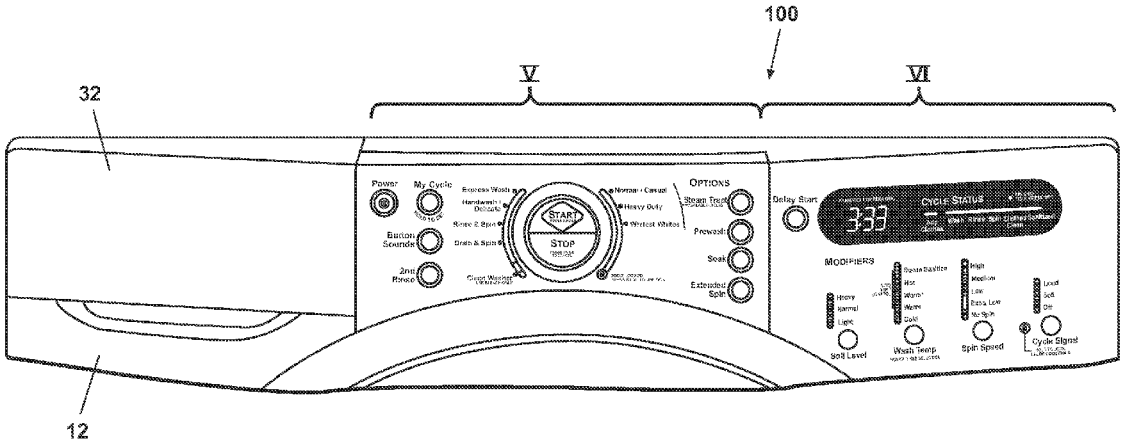
FIG. 4 is a front view of the control panel of FIG. 1

FIG. 4 illustrates an enlarged view of the exemplary control panel 100 of the washing machine 10. The control panel 100 is shown for illustrative purposes as being mounted to a front portion of the cabinet 12 but may be mounted in any desirable location on the washing machine 10. The control panel 100 may be mounted to the washing machine 10 or can be integrated into a remote device for remotely controlling the washing machine 10. In FIG. 4, two regions of the control panel 100 are identified by the Roman numerals V and VI, and these regions are each shown in enlarged views in corresponding FIGS. 5 and 6 for readability.

Figure 5:
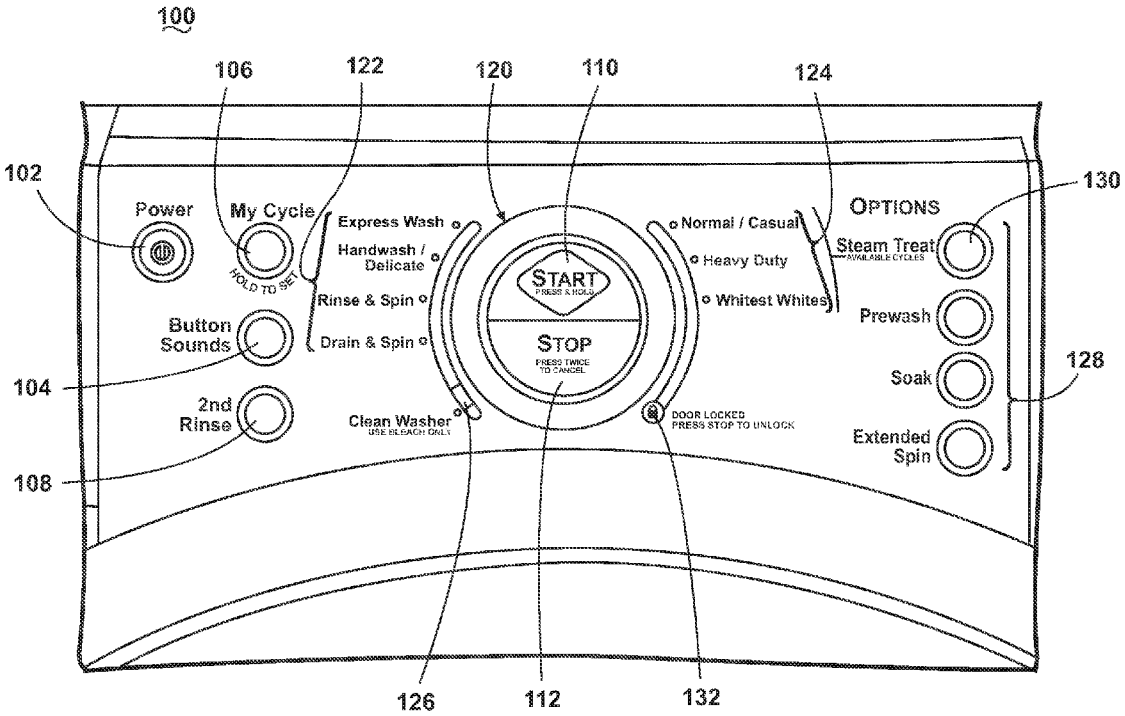
FIG. 5 is an enlarged view of the region labeled V in FIG. 4.

Referring now to FIG. 5, the control panel 100 may include a plurality of various selectors that enable a user to interact with the control panel 100 and thereby enter input related to the operation of the washing machine 10. For example, the control panel 100 may include a power selector 102 to turn the washing machine 10 on or off, a button sound selector 104 for choosing a desired sound or set of audible sounds to be used when a user interacts with the control panel 100, a My Cycle selector 106 for setting a user-defined operation cycle, and a second rinse selector 108 to add an additional rinse step to an operation cycle. Other examples of selectors include a start selector 110 to initiate and/or resume an operation cycle and a stop selector 112 to terminate or pause an operation cycle.

In the illustrated control panel 100, the start selector 110 and the stop selector 112 may be located within an operation cycle selector 120. The operation cycle selector 120 may provide several selectable operation cycles from which a user can select a desired operation cycle. The exemplary operation cycle selector 120 may group the selectable operation cycles according to one or more common aspects of the selectable operation cycles. For example, the selectable operation cycles can include a non-steam operation cycle group 122, a steam operation cycle group 124, and a washing machine wash operation group 126, which, in the current embodiment, contains a clean washer operation cycle for cleaning the washing machine to remove bacteria and the like. Optionally, the clean washer cycle can employ steam, and exemplary clean washer operation cycles employing steam are described in U.S. patent application Ser. No. 11/745,231, filed May 7, 2007, entitled METHOD FOR TREATING BIOFILM IN AN APPLIANCE, which is incorporated herein by reference in its entirety. In the exemplary illustrated embodiment, the non-steam operation cycle group 122 includes express wash, handwash/delicate, rinse & spin, and drain & spin operation cycles, and the steam operation cycle group 124 include normal/casual, heavy duty, and whitest whites operation cycles.

The exemplary control panel 100 may provide an options selector 128 with options selectable for use with the operation cycles. The options selector 128 of the illustrated embodiment includes prewash, soak, and extended spin options and a steam treat option 130. Optionally, the options selector 128 can visually communicate, such as by a light emitting diode (LED) or other illumination source, to the user when one or more of the options is available for use with a selected operation cycle from the operation cycle selector 120 or when the option has been selected. For example, the inner ring of the steam treatment option 130 may define a push button selector for selecting the steam treat option. The space between the outer ring and inner ring of the steam treatment option 130 may define a light emitting area that may be illuminated by an illumination device to function as the visual indicator. The light emitting area may be illuminated as a first color if the option is available and as a second color if the option is selected. The different illumination colors can be achieved by use of a multi-color LED. In addition to or in place of different colors, different illumination intensities can be used to indicate the status. The other selectors may have the same or similar structure as that described here for the stream treatment option 130.

The steam treat option 130 may be available as an option for the operation cycles in the steam operation cycle group 124, which can be communicated to the user in manners in addition to or as an alternative to illumination. For example, the steam treat option 130 may be positioned adjacent to the steam operation cycle group 124 with a bracket or other printing on the control panel 100 linking the steam treat option 130 to the steam operation cycle group 124. The steam treat option 130 will be described in further detail below.

Another feature of the control panel 100 shown in FIG. 5 may be a door condition indicator 132, which may communicate to the user whether the door 26 is in a locked condition. The door condition indicator 132 may also function as a selector for the user to unlock the door 26 if the door condition indicator 132 indicates that the door 26 is in a locked condition.

Figure 6:
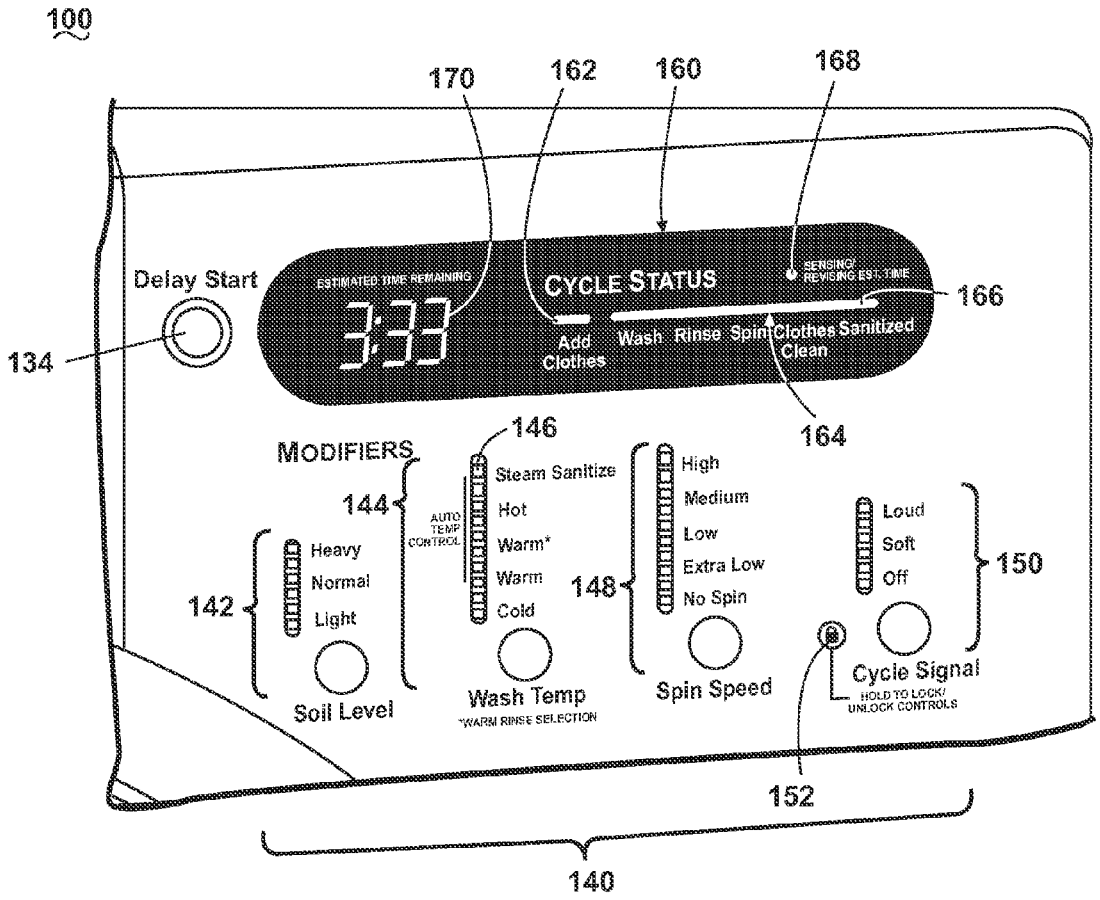
FIG. 6 is an enlarged view of the region labeled VI in FIG. 4.

Referring now to FIG. 6, the control panel 100 may further have delay start selector 134, which may allow the user to delay the initiation of a selected operation cycle for one or more periods of time.

The control panel 100 may further include modifier selectors 140 that may allow a user to modify and/or set a setting of a selected operation cycle or of the washing machine 10. For example, the modifier selectors 140 may be a soil level selector 142 to select a soil level of the laundry, a wash temp selector 144 to select a temperature of wash liquid for a wash step of a selected operation cycle, a spin speed selector 148 to select a spin speed for a spin step of a selected operation cycle, and a cycle signal selector 150 to select whether a cycle signal is desired and, if so, a desired volume for the cycle signal. The wash temp selector 144 may include a steam sanitize option 146, which will be discussed in further detail below. Each of selectors 142, 144, 148, and 150 in the modifier selectors 140 may include a visual indicator, such as an LED or other illumination source, to communicate to the user a selected modifier.

In the case of the modifier selectors 142, 144, 148, and 150, each of the selectors may perform the role of multiple for selectors. For example, the wash temp selector 146 performs as a cold selector, warm selector, warm rinse selector, hot selector, and steam sanitize selector. In the case of the steam sanitize selector, it may perform the function of causing the controller to implement a steam sanitizing cycle separate from or by modifying one of the predetermined operation cycles.

Another feature of the control panel 100 shown in FIG. 6 may be a controls lock indicator 152, which may communicate to the user whether the control panel 100 is in a locked condition (i.e., the selectors are deactivated and cannot be selected). The controls lock indicator 152 may also function as a selector for the user to lock and unlock the control panel 100.

The control panel 100 of the present embodiment may further provide a cycle status indicator 160 to communicate to the user a status of a running operation cycle. The cycle status indicator 160 may also communicate to the user instructions necessary for the user to follow for execution of the operation cycle. For example, an add clothes indicator 162 may inform the user that the user should add clothes or other fabric items to the drum 16. The cycle status indicator 160 may have an operation cycle and clothes status indicator 164. In the illustrated example, the operation cycle and clothes status indicator 164 is shown as a single indicator, but the operation cycle and clothes status indicator 164 may be separate indicators, such as a cycle status indicator and a separate clothes status indicator. The cycle status indicator portion of the operation cycle and clothes status indicator 164 may have a visual indicator corresponding to various steps, such a wash, rinse, and spin, of an operation cycle. When one of the steps is being executed or is completed, the corresponding visual indicator may activate to communicate the corresponding status to the user. The clothes status indicator portion of the operation cycle and clothes status indicator 164 may have a visual indicator corresponding to various conditions, such as clean and sanitized, of the clothes and may activate when the clothes have achieved a corresponding condition during or after execution of the operation cycle. In particular, the clothes status indicator portion of the operation cycle and clothes status indicator 164 may include a sanitized indicator 166 that may communicate to the user when the clothes have been sanitized with steam. The sanitized indicator 166 will be described in further detail below.

The operation cycle indicator portion and the clothes status indicator portion of the operation cycle and clothes status indicator 164 may be configured to communicate to the user the operation cycle status and the clothes status simultaneously or at different times. For example, the operation cycle status indicator can communicate to the user the status of a running operation cycle as the operation cycle progresses, and the clothes status indicator can communicate to the user the status of the clothes during and/or after corresponding steps of the operation cycle or at the end of the operation cycle. Thus, in the illustrated embodiment, the sanitized indicator 166 may change from a non-indicating state to an indicating state by illuminating or changing illumination color, in the case of a light source, or otherwise activating during a step of the operation cycle in which the clothes are sanitized, after the step of the operation cycle in which the clothes are sanitized, or at the end of the operation cycle in which the clothes are sanitized. When the sanitized indicator 166 activated during or after a step of the operation cycle, the sanitized indicator 166 may remain activated for the remainder of the operation cycle or may be activated for a desired portion of the operation cycle. When the sanitized indicator 166 includes an illumination source, activation may be in the form of continuous illumination, flashing illumination, periodic illumination, or a combination thereof.

The clothes may be determined to be sanitized according to any suitable method, such as the clothes reaching a predetermined sanitization temperature. The sanitization temperature can be an empirically determined temperature or can be a temperature set by a sanitization standard. In the sense of sanitizing to kill the microorganisms, the sanitizing process is a combination of temperature and time at temperature. Generally, the higher the temperature, the shorter the time at that temperature needed to kill the microorganisms. For the type of microorganisms commonly found in washing machines, there is a generally accepted lower temperature of 55° C. below which heat alone will not kill the microorganisms regardless of the length of time the microorganisms are exposed to these temperatures. However, if heat is used in combination with a chemistry, such as chlorine bleach or oxygenated bleach (a/k/a color safe bleach), lower temperatures can be used to sanitize. It is possible to sanitize solely with chemistry, but such a heavy use of chemistry may lead to the fabric breaking down more quickly.

Because of overall cycle time constraints, especially when heat alone is used to sanitize, the temperature is normally 60° C. or greater. A brief listing of sanitizing time and temperatures will aid in understanding. For 100° C., the temperature need only be maintained at about one minute to sanitize. For 70° C., the time is approximately 7 minutes. For 65° C., the time is approximately 20 minutes. For 55° C. the time is approximately one hour. As the temperature decreases and the corresponding time increases, there will come a point where the time to sanitize is greater than the time for the desired wash cycle, which will require that the wash cycle be extended, which is counter to the desire of most consumers, who generally prefer shorter wash cycles. The higher temperatures are normally balanced against the energy required to produce them. For example, most appliances in the United States have an approximately 115 V electrical supply, which inherently limits the wattage of the heater in the steam generator. In European countries, 220 V electrical supply is more common. In either case, there is a practical consideration on the rate and temperature at which heat or steam can be provided.

To complete the sanitizing within a time acceptable to the consumer, it has been determined that temperatures above 60° C. should be used. To avoid using more exotic or expensive heat systems or steam generators, a preferred range for the sanitization temperature may be from about 65° C. to about 75° C. Within this range, it has been determined that an exemplary suitable sanitization temperature is about 70° C. These ranges and specific temperatures have been found to address the overall cycle times and the heating requirements for current washers.

Sanitize as used in this application relates to the killing or stopping of growth of microorganisms commonly found in a washing machine. Sanitize as used herein includes, but does not require, that all microorganisms in the washing machine be killed or have their growth stopped. Sanitize as used in the application includes the killing or retarding of the growth of some of the microorganisms.

Another feature of the control panel 100 shown in FIG. 6 may be an estimated time remaining indicator 170, which may communicate to the user an estimated remaining time of a selected or running operation cycle. The cycle status indicator 160 may include a time revising indicator 168 to communicate to the user that the controller 70 is calculating and/or revising the remaining time.

Figure 7:
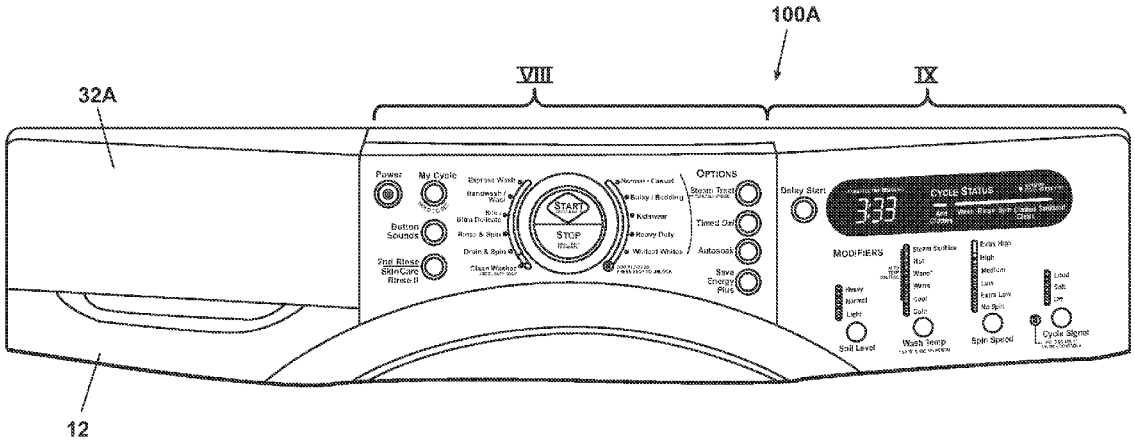
FIG. 7 is a front view of an alternative exemplary control panel according to another embodiment of the invention.
Figure 8:
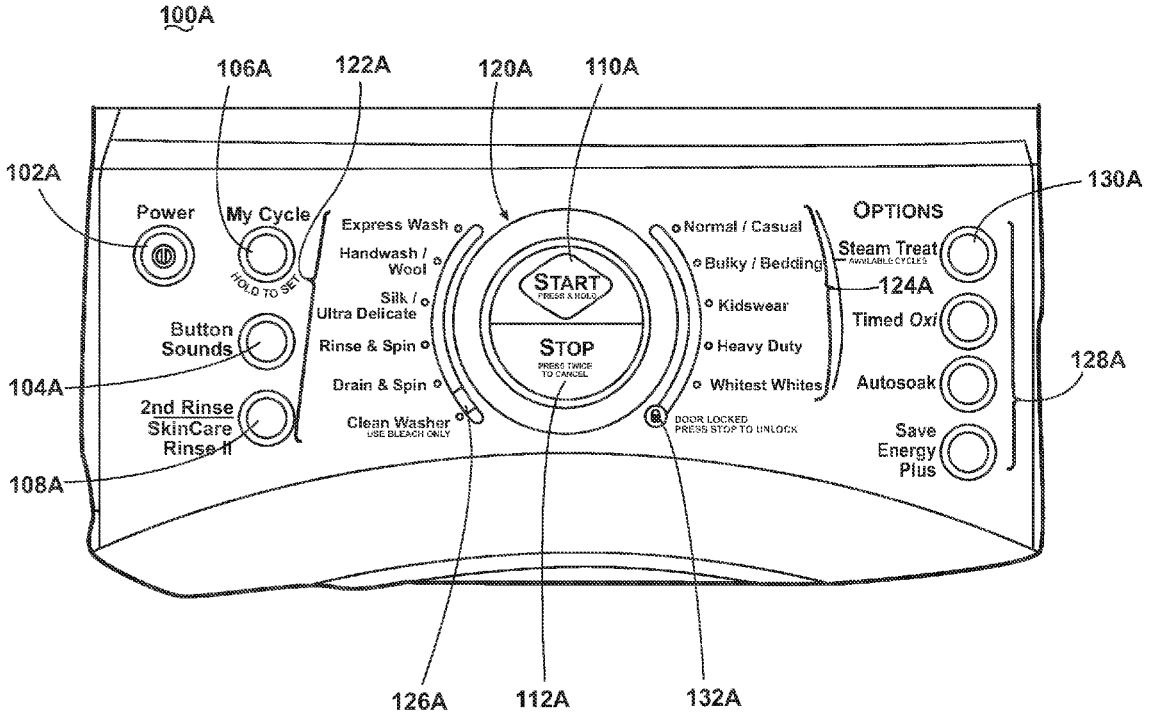
FIG. 8 is an enlarged view of the region labeled VIII in FIG. 7.
Figure 9:
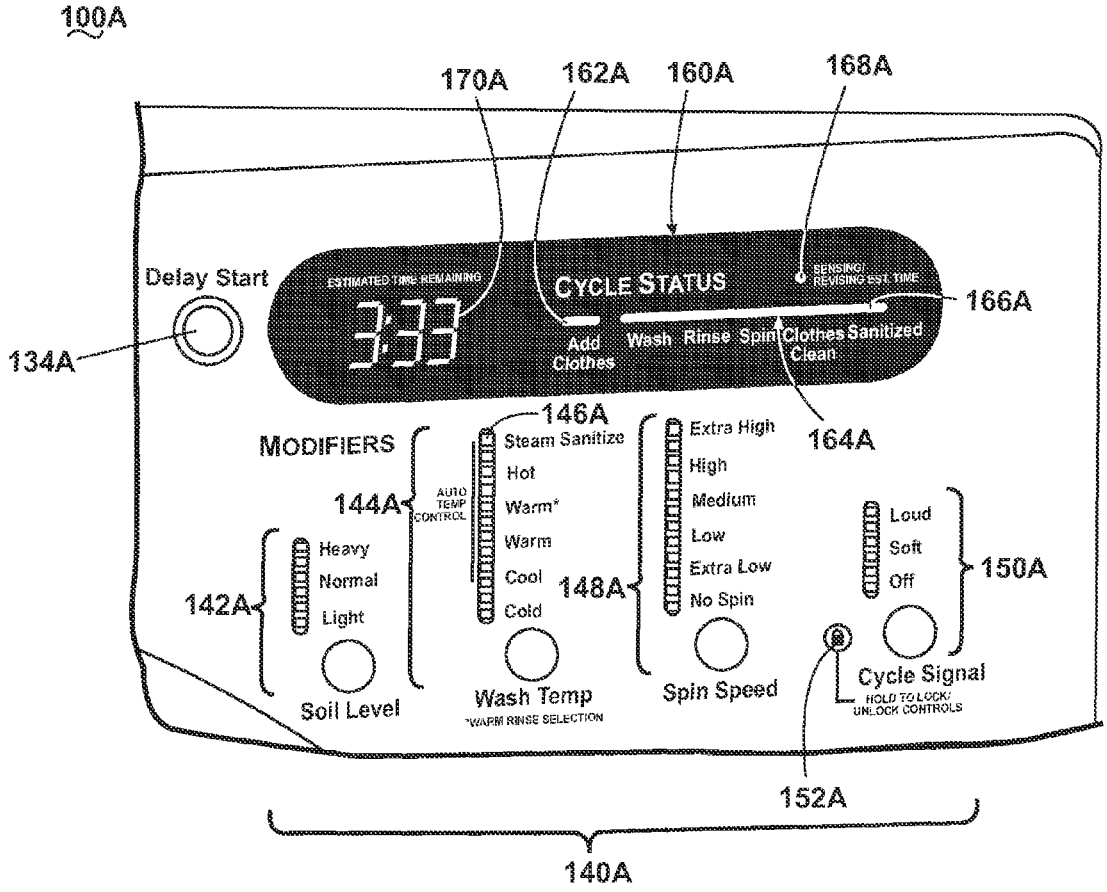
FIG. 9 is an enlarged view of the region labeled IX in FIG. 7.

Another embodiment of an exemplary control panel 100A is illustrated in FIGS. 7-9, which are views corresponding to those of FIGS. 4-6. Components of the control panel 100A in FIGS. 7-9 similar to those of the control panel 100 of FIGS. 4-6 are identified by the same reference numeral bearing the letter "A." The control panel 100A is identical to the control panel 100, except that the former has an additional skincare rinse II corresponding to the second rinse selector 108A, additional and/or different operation cycles in the non-steam operation cycle group 122A, additional operation cycles in the steam operation cycle group 124A, different options in the options selector 128A, and additional options for the wash temp selector 144A and the spin speed selector 148A. One of the different options in the options selector 128A is timed oxi option, which may add one or more hydrogen peroxide cleaners or other oxidizing cleaners to a selected operation cycle. The timed oxi option may be an option for an operation cycle in the steam operation cycle group 124A, and selection of the timed oxi option and the steam treat option 130A and/or the steam sanitize option 146A may incorporate both steam and hydrogen peroxide cleaners or other oxidizing cleaners into the selected operation cycle to provide additional cleaning and sanitization benefits.

In both exemplary embodiments of the control panel 100, 100A, several of the selectors and indicators may relate to the use of steam in the washing machine 10. In particular, the washing machine wash operation group 126, 126A in the operation cycle selector 120, 120A, the steam treat option 130, 130A in the options selector 128, 128A, the steam sanitize option 146, 146A in the modifier selectors 140,140A and the sanitized indicator 166, 166A relate to the use of steam in the washing machine. While any of the selectors and indicators on the control panel 100, 100A may have a visual indicator, such as an illumination source, the visual indicator of the selectors and indicators related to the use of steam may have a common characteristic of the visual indicator that differentiates them from the other selectors and indicators. For example, the selectors and indicators related to the use of steam may have a visual indicator of a color, such as blue, different than the color(s) used for the visual indicators of the other selectors and indicators.

As described above, steam may be employed in an operation cycle at the discretion of the user, such as by selecting the steam treat option 130 and/or the steam sanitize option 146. The steam treat option can be used by the controller to heat with steam. The heating with steam can be sufficient to effect a sanitization of the fabric items. When such sanitizing occurs, the steam treat option essentially implements a sanitization cycle. The steam treat option 130 is implemented by the controller as a separate cycle that modifies one of the operation cycles 124 or is run as a separate cycle. When the steam treat option sanitizes, it is a sanitizing cycle.

Figure 10:
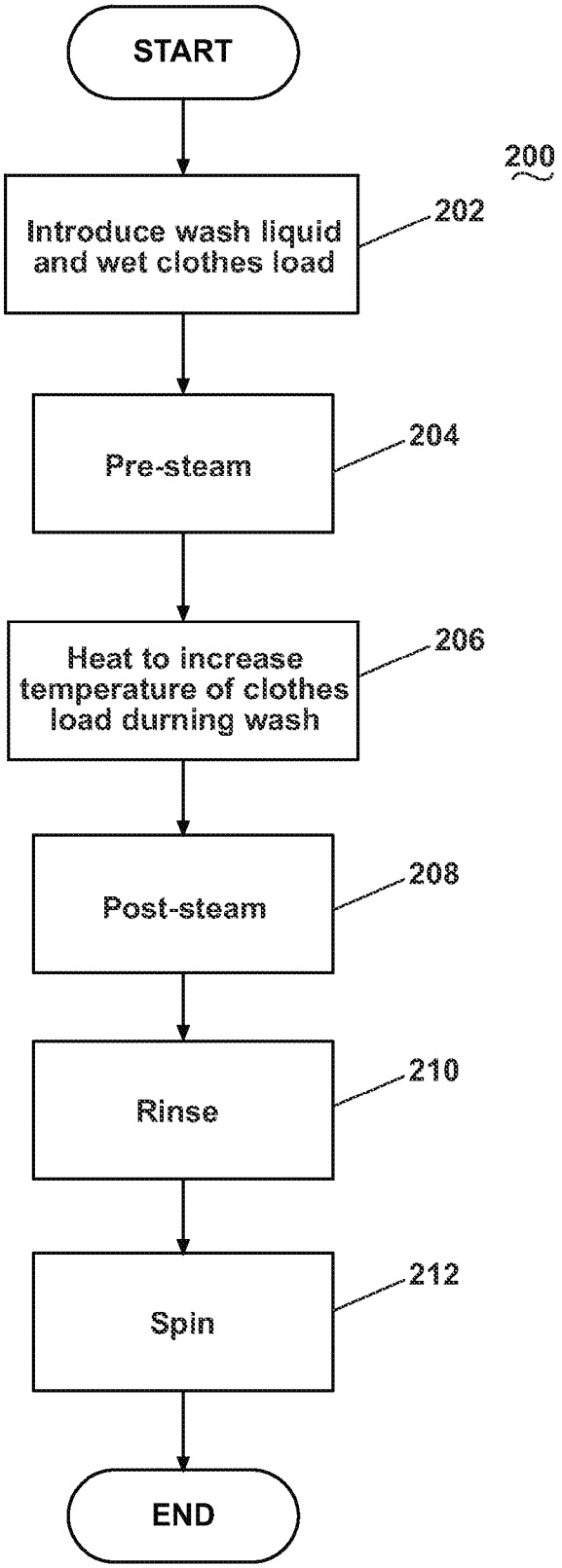
FIG. 10 is a flow chart of an embodiment of a steam operation cycle for the fabric treatment appliance of FIG. 1.
Figure 11:
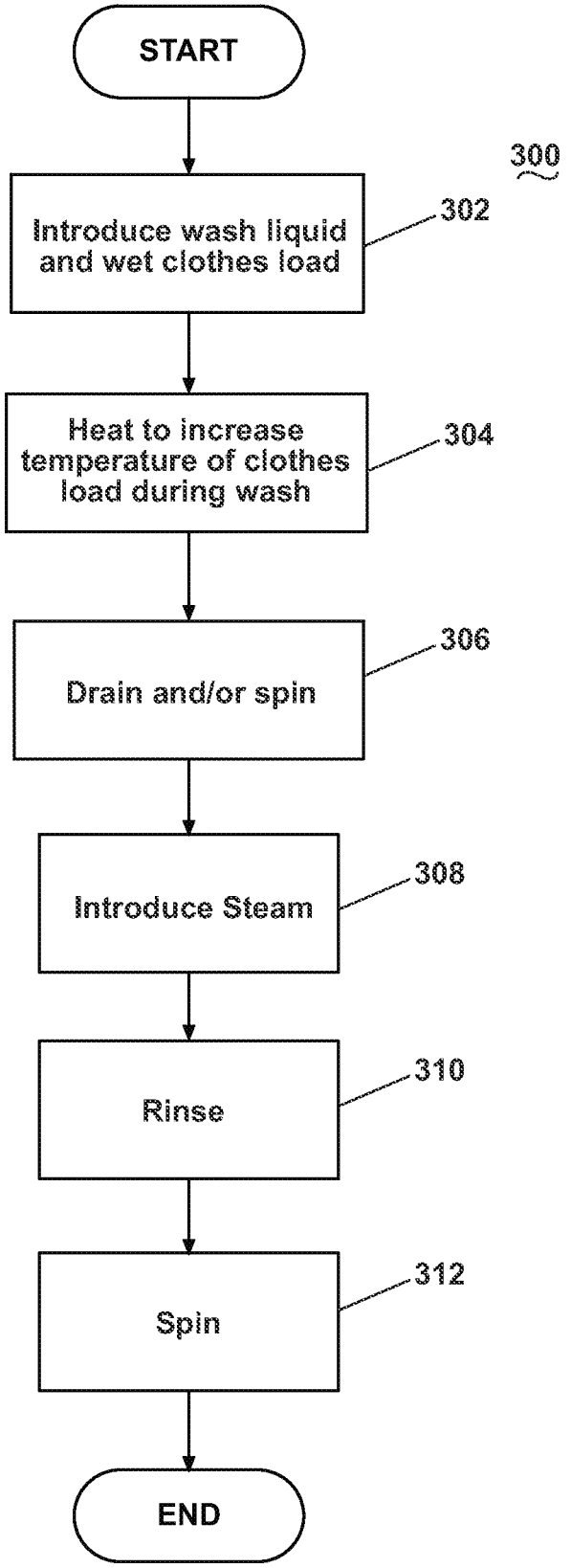
FIG. 11 is a flow chart of another embodiment of a steam operation cycle for the fabric treatment appliance of FIG. 1.

Examples of steam operation cycles accessible through the steam treat option 130 and/or the steam sanitize option 146 follow. The steam operation cycles described in FIGS. 10 and 11 are provided for exemplary purposes; it is within the scope of the invention for the steam treat option 130 and the steam sanitize option 146 to correspond to other steam operation cycles. It is also within the scope of the invention for the steam operation cycles described below to be directly selectable from the operation cycle selector 120 without requiring an addition input from the user through the options selector 128 or the modifier selectors 140.

User selection of one of the operation cycles in steam operation cycle group 124 and user selection of the steam treat option 130 may implement, for example, a steam operation cycle 200 shown in the flow chart of FIG. 10. The steam operation cycle 200 may begin with step 202 of introducing wash liquid, such as water alone or water with a detergent, into the tub 14 to wet a clothes load in the drum 16. The clothes load may be wet in any suitable manner, such as by at least partially submerging the clothes load in the drum 16 and, optionally, rotating the drum 16 such that the clothes load rotates through the wash liquid or by recirculating the wash liquid from the tub 14 to the drum 16 through the recirculation conduit 48, which would not require submerging at least a portion of the drum 16 and the clothes load in the wash liquid.

At step 204, steam may be introduced into the tub 14 and/or the drum 16 (hereinafter referred to as introducing steam into the tub 14) to heat the wet clothes load and the wash liquid as a pre-steam. The duration of steam introduction may be determined in any suitable manner. For example, the steam may be introduced for a predetermined time and/or until the clothes load reaches a predetermined temperature. An exemplary duration for the steam introduction may be about 2-20 minutes, and an exemplary duration for the steam introduction within this range is about 5 minutes. Advantages of introducing the steam as a pre-steam after wetting the clothes load may include activating enzymes in the detergent, if included in the wash liquid, faster than without introduction of steam and earlier (relative to later in the steam operation cycle) to avoid setting protein stains. During the steam introduction, the drum 16 may rotate in any suitable manner, such as at a tumble speed, a spin speed, or a combination of tumble and spin speeds in alternating directions or one direction. Further, the wash liquid may be recirculated during the steam introduction.

After the pre-steam, heat may be introduced at step 206 into the tub 14 and/or the drum 16, such as by steam or from the sump heater 52 located in the sump 38, to raise the temperature of the clothes load while washing the clothes load. The heat may be introduced for a predetermined time or until the clothes load and/or wash liquid reaches a predetermined washing temperature. An exemplary predetermined temperature is about 58° C. The washing of the clothes load may include drum rotation and/or recirculation of the wash liquid as described above for the step 204.

At step 208, steam may be introduced into the tub 14 as a post-steam to raise and/or maintain the temperature of the clothes load achieved during the step 206. Continuing with the example provided above, if the clothes load reaches about 58° C. during the step 206, then the steam may raise the temperature to about 60° C. during the post-steam or higher, if desired. The steam may be introduced to maintain the temperature of the clothes load at a desired temperature for a predetermined time. For example, the washing temperature and time for some cycles may not be high enough to sanitize the clothes and the steam may be introduced for a predetermined time to sufficiently sanitize the clothes load at the desired temperature. The steam may also be introduced to maintain the temperature at or above a sanitizing temperature for the predetermined time. If the clothes load becomes sanitized during the steam operation cycle 200, the sanitized indicator 166 may be activated, such as at the incidence of the clothes load becoming sanitized or after the steam operation cycle 200 ends. The determination of the clothes load becoming sanitized may be made by the controller, which can have preprogrammed data, such as the time and temperature data as previously described, which is indicative of the clothes being sanitized for the given standard. For example in the case where the internal temperature is maintained at 65° C. or higher for more than 20 minutes, the controller may then determine that the clothes load is sanitized. Drum rotation and/or recirculation of the wash liquid may be employed as described above for the step 204. The steam operation cycle 200 may be combined with the oxi option to improve the sanitization result or reduce its time and/or temperature parameters as previously described.

The prefixes "pre-" and "post-" for the pre-steam and post-steam steps 204, 208 are not intended to limit the introduction of steam to occurring only before and after the washing in the step 206. The introduction of steam during these steps may occur only before or after the washing or can overlap with the washing. Further, the steam operation cycle 200 can include both the pre-steam and the post-steam or only one of the pre-steam and the post-steam.

Following the post-steam, the steam operation cycle 200 may proceed in any desired manner, such as, for example, with a rinse step 210 and a spin step 212. The steam operation cycle 200 may include other steps commonly used in washing machine operation cycles, such as a pre-wash, a high concentration detergent wash, intermediate spins, multiple rinses, and multiple final spins.

Various drain steps for draining wash liquid from the tub 14 may also be incorporated. For example, a drain step may be implemented after the heating step 206 and before the post-steam step 208. The removal of the wash liquid may require less steam to raise the temperature in the chamber 15 because there is less wash liquid to heat. A drain step typically follows the rinse step 210, especially prior to a spin step, such as the spin step 212. A drain step may also be performed during or after the spin step 212 to remove the wash liquid extracted by the spinning.

User selection of one of the operation cycles in steam operation cycle group 124 and user selection of the steam sanitize option 146 may implement, for example, a steam operation cycle 300 shown in the flow chart of FIG. 11. The steam operation cycle 300 may begin with step 302 of introducing wash liquid, such as water alone or water with a detergent, into the tub 14 to wet a clothes load in the drum 16. The clothes load may be wet in any suitable manner, such as by at least partially submerging the clothes load in the drum 16 and, optionally, rotating the drum 16 such that the clothes load rotates through the wash liquid or by recirculating the wash liquid from the tub 14 to the drum 16 through the recirculation conduit 48, which would not require submerging at least a portion of the drum 16 and the clothes load in the wash liquid.

Heat may be introduced at step 304 into the tub 14 and/or the drum 16, such as by steam or from a sump heater located in the sump 38, to raise the temperature of the clothes load while washing the clothes load. The heat may be introduced for a predetermined time or until the clothes load and/or wash liquid reaches a predetermined temperature. An exemplary range of predetermined temperatures is about 57° C.-60° C. The washing of the clothes load may include drum rotation and/or recirculation of the wash liquid as described above for the step 204.

The wash liquid may optionally be drained from the tub 14 alone or in combination with spinning of the drum 16 to remove some wash liquid from the clothes load in step 306. If the spinning of the drum 16 is executed, the clothes load remains wet after the spinning. The draining of the wash liquid and/or spinning of the drum 16 removes excess wash liquid from the clothes load, the drum 16, and the tub 14 so that introduced steam may function to primarily heat the wet clothes load rather than heating the clothes load and the excess wash liquid, which requires more energy.

Steam may be introduced for sanitization at step 308. While the temperature of the clothes load may have decreased slightly during the drain and/or spin of the step 306, the temperature may remain at or near the temperature of the clothes load following the heating in the step 304. The steam introduced into the tub 14 may raise the temperature of the clothes load to a predetermined temperature for sanitization and, optionally, maintain the predetermined temperature for a predetermined time. As stated above, the sanitization temperature can be an empirically determined temperature or can be a temperature set by a sanitization standard. An exemplary temperature range for the sanitization temperature is about 55° C.-75° C. When the clothes load becomes sanitized during the steam operation cycle 300, the sanitized indicator 166 may be activated, such as at the incidence of the clothes load becoming sanitized or after the steam operation cycle 300 ends. During the steam introduction, the drum 16 may rotate in any suitable manner, such as at a tumble speed, a spin speed, or a combination of tumble and spin speeds in alternating directions or one direction. If any wash liquid remains in the tub 14, the wash liquid may be circulated through the recirculation conduit 48.

Following the sanitization, the steam operation cycle 300 may proceed in any desired manner, such as, for example, with a rinse step 310 and a spin step 312. The steam operation cycle 300 may include other steps commonly used in washing machine operation cycles, such as a pre-wash, a high concentration detergent wash, intermediate spins, multiple rinses, and multiple final spins.

It should be noted that the sanitizing indicator may indicate that sanitization has occurred any time after the clothes load has become sanitized by the applicable standard. Non-limiting examples of when the indication can occur are: at the moment sanitization has occurred, at the end of the corresponding step in the overall wash cycle, at the end of the steam step in the overall wash cycle, and at the end of the overall wash cycle. The type of indication can also differ from what is shown, which is the illumination of a light or the change of color of the light. Other well known indicators, visual or audible, may also be used, alone or in combination with each other. Other visual indicators include the movement of a dial or the setting of a flag. Audible indicators may include a predetermined tone or series of tones if the appliance is Internet enable, the indication may include the send of an e-mail, which itself may contain a visual or audible indicator.

It should also be noted that the sanitizing indicator is not limited to indicating when only one of the stream treat option or steam sanitize option are selected. For that matter it is not limited to only cycles with steam. The other cycles, depending on the selected options, may maintain temperatures for a sufficient time to meet the sanitized standard being applied. Therefore, any reference to a sanitizing laundry cycle in this application refers not only to an express sanitized laundry cycle, such as available through the steam treat option and the steam sanitize option, but also includes any wash cycle during which the clothes load is sanitized.

In another embodiment, the steam sanitize option 146 may be selected in combination with a steam operation cycle and the steam treat option 130 to set the temperature reached during the post-steam to be at least a sanitization temperature. Alternatively, selection of both the steam treat option 130 and the steam sanitize option 146 for a steam operation cycle may correspond to a hybrid of the steam operation cycles 200, 300 described above. For example, the drain and/or spin step 306 and the steam introduction step 308 of the steam operation cycle 300 may be incorporated into the steam operation cycle 200, such as after the post-steam step 208. Such a hybrid step may incorporate both the pre-steam and the post-steam or only one of the pre-steam and the post-steam.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for controlling a household washing machine for washing laundry comprising:

implementing a sanitizing laundry cycle by:

receiving, in a user interface, an input indicative of a user-selected desired sanitizing cycle;

relating, in a controller, the input of the desired sanitizing cycle with temperature data and time data from a set of sanitization data stored in memory and indicative of sanitizing;

actuating, by the controller, a steam generator to heat the laundry to a predetermined temperature in accordance with the temperature data;

heating, by the controller, the laundry for a predetermined time after reaching the predetermined temperature in accordance with the time data; and actuating, by the controller, a sanitized indicator indicating sanitization of the laundry upon completion of the sanitizing laundry cycle.

2. The method according to claim 1 wherein the implementing a sanitizing cycle comprises altering a predetermined operation cycle.

3. The method according to claim 2 wherein the altering of the operation cycle comprises raising the temperature in a wash chamber above the predetermined temperature.

4. The method according to claim 3 wherein the raising of the temperature comprises introducing steam into the wash chamber.

5. The method according to claim 4 wherein the predetermined operation cycle comprises at least one of a pre-steam step, a heating step, and a post-steam step, and heating the laundry to the predetermined temperature includes heating the laundry to the predetermined temperature during at least one of the pre-steam step, heating step, and post-steam step to effect the sanitizing laundry cycle.

6. The method according to claim 2 wherein the altering of the operation cycle comprises heating the laundry to the predetermined temperature after the completion of a wash step of the predetermined operation cycle.

7. The method according to claim 6 wherein the heating the laundry to the predetermined temperature occurs prior to a rinse step of the predetermined operation cycle.

8. The method according to claim 1 wherein the implementing of the sanitizing laundry cycle occurs upon the completion of a predetermined operation cycle.

9. A method for controlling a household washing machine for washing laundry within a wash chamber, comprising:

implementing a laundry washing cycle; and implementing a sanitizing laundry cycle upon the completion of the laundry washing cycle by:

receiving, in a user interface, an input indicative of a user-selected desired sanitizing cycle;

relating, in a controller, the input of the desired sanitizing cycle with temperature data and time data from a set of sanitization data stored in memory and indicative of sanitizing;

actuating, by the controller a steam generator to heat the laundry to a predetermined temperature in accordance with the temperature data;

heating, by the controller, the laundry for a predetermined time after reaching the predetermined temperature in accordance with the time data; and actuating, by the controller, a sanitized indicator indicating sanitization of the laundry upon completion of the sanitizing laundry cycle.

10. The method of claim 9 wherein the implementing of the laundry cycle is done at temperatures less than the predetermined temperature.

11. The method of claim 9 wherein the implementing of the sanitizing laundry cycle comprises introducing steam into the wash chamber to raise the temperature in the was chamber to the predetermined temperature.

12. The method of claim 11 wherein the steam is introduced for the predetermined time.

13. A method for controlling a household washing machine for washing laundry comprising:

implementing a sanitizing laundry cycle by:

receiving, in a user interface, an input indicative of a user-selected desired sanitizing cycle;

relating, in a controller, the input of the desired sanitizing cycle with temperature data and time data from a set of sanitization data stored in memory and indicative of sanitizing;

actuating, by the controller, a steam generator to heat the laundry to a predetermined temperature in accordance with the temperature data;

upon heating the laundry to the predetermined temperature as sensed by a temperature sensor, further heating the laundry, by the controller, for a predetermined cycle time after reaching the predetermined temperature in accordance with the time data; and actuating, by the controller, a sanitized indicator indicating sanitization of the laundry upon completion of the sanitizing laundry cycle.

* * * * *